US006065749A

United States Patent [19]

Debie

[11] Patent Number: 6,065,749

[45] Date of Patent: May 23, 2000

[54] JOURNEY BOARD GAME

[76] Inventor: Deborah Kay Debie, 609 E. 40th St. #2 East, Kansas City, Mo. 64110

[21] Appl. No.: 09/160,159

[22] Filed: Sep. 25, 1998

[51] Int. Cl.[7] ..... A63F 3/00

[52] U.S. Cl. ..... 273/243; 273/251; 273/431

[58] Field of Search ..... 273/243, 249, 273/250–254, 429–432, 440

[56] References Cited

U.S. PATENT DOCUMENTS 4,736,954 4/1988 Haney et al. .
4,889,345 12/1989 Wawryk .
4,907,808 3/1990 Turner et al. .
5,152,535 10/1992 Roberts .
5,224,862 7/1993 Sullivan .
5,813,671 9/1998 Barratt .

FOREIGN PATENT DOCUMENTS 2187393 2/1987 United Kingdom .

*Primary Examiner*—William M. Pierce

[57] ABSTRACT

A board game is provided including a game board with a top face having a plurality of spaced large designations each with number indicia and theme indicia situated therein. The top face of the game board further includes a plurality of small designations situated between each of the large designations. Each of the small designations has answer indicia positioned therein. Also included is a plurality of dice and a plurality of playing pieces. A plurality of theme cards are provided each having a plurality of numbered lines relating to various themes.

7 Claims, 4 Drawing Sheets

10. SANCTUARY OF EARTH

1. WORKING ON THE FINAL PHASE OF MY.....
2. I BLESS ALL THAT I GIVE, ALL.....
3. COMPLETION FREES ME FOR MY NEXT.....
4. I AM ALWAYS EVOLVING, A WORK IN.....
5. MATERIAL RESOURCES ARE A.....
6. WHAT IS THE REAL VALUE TO ME ?
7. I DO NOT ALWAYS GET WHAT I.....

40

FIG. 7

SUBJECT

*CAREER, WORK, FINANCES*

1. WHAT IS HAPPENING.....
2. WHY AM I IN THIS.....
3. WHAT DO I NEED TO.....
4. HOW HAVE I PREPARED..
5. WHAT SEEDS HAVE I.....
6. WHAT IS GROWING FROM..
7. WHAT AM I DOING.....
8. WHAT IS GOING ON.....
9. WHAT DO I REALLY.....
10. WHAT ROAD AM I TAKING..

42

FIG. 8

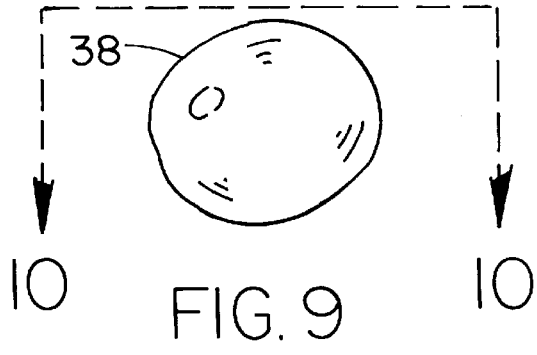

FIG. 9

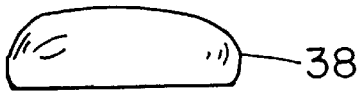

FIG. 10

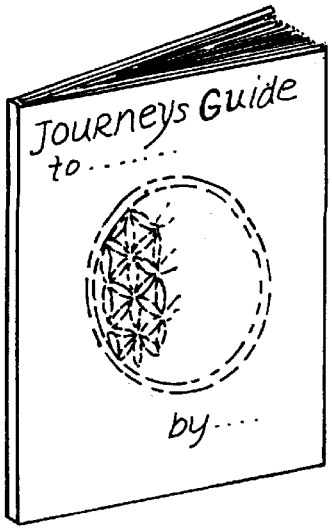

FIG. 11

JOURNEY BOARD GAME

BACKGROUND OF THE INVENTION

1. Field of the Invention

The present invention relates to board games and more particularly pertains to a new mystic board game for providing entertainment by generating answers to various questions.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 4,443,010; U.S. Pat. No. 4,560,169; U.S. Pat. Des. 255,699; U.S. Pat. No. 4,930,788; U.S. Pat. No. 5,405,150; and U.S. Pat. No. 5,451,050.

In these respects, the mystic board game according to the present invention substantially departs from the conventional concepts and designs of the prior art, and in so doing provides an apparatus primarily developed for the purpose of providing entertainment by generating answers to various questions.

SUMMARY OF THE INVENTION

In view of the foregoing disadvantages inherent in the known types of board games now present in the prior art, the present invention provides a new mystic board game construction wherein the same can be utilized for providing entertainment by generating answers to various questions.

The general purpose of the present invention, which will be described subsequently in greater detail, is to provide a new mystic board game apparatus and method which has many of the advantages of the board games mentioned heretofore and many novel features that result in a new mystic board game which is not anticipated, rendered obvious, suggested, or even implied by any of the prior art board games, either alone or in any combination thereof.

To attain this, the present invention generally comprises a game board having a planar rectangular configuration with a top face. As shown in FIG. 1, the game board has a plurality of spaced large circles each having number indicia and theme indicia, or sanctuary indicia, situated therein. Each of the large circles is situated within one of three columns. It should be further noted that the large circles arc staggered from top to bottom. The top face of the game board further includes a plurality of small circles, or stepping stones, situated between each of the large circles. The small circles remain in linear alignment. Further, a bold linear line connects the small circles and the large circles. It should be noted that each of the small circles has answer indicia positioned therein. FIGS. 4–6 show a plurality of dice including a red dice having eight sides with number indicia thereon ranging from 0–7. Associated therewith is a white dice having ten sides with number indicia thereon ranging from 1–10. An instruction sheet is provided having a rectangular periphery defined by a pair of elongated side edges and a pair of short end edges. As shown in FIGS. 2 & 3, the instruction sheet includes a plurality of folds extending between the elongated side edges for defining a plurality of sections. Such sections include rule sections on a front and back of the instruction sheet. Each section serves for displaying rules associated with one of a plurality of games. Also on the instruction sheet is a journal section having two columns of a plurality of rows of blank lines. The rows of blank lines are divided up into groups each having theme indicia adjacent thereto. Such theme indicia corresponds with that of one of the large circles of the game board. FIGS. 9 & 10 show a plurality of playing pieces constructed from glass and having an arcuate upper surface and a flat lower surface. FIG. 7 depicts one of a plurality of theme cards each having a number associated therewith. Further situated on each theme card is a plurality of numbered lines each relating to one of various themes. Finally, a plurality of subject cards are provided each having a plurality of numbered lines each relating to one of various themes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mystic board game apparatus and method which has many of the advantages of the board games mentioned heretofore and many novel features that result in a new mystic board game which is not anticipated, rendered obvious, suggested, or even implied by any of the prior art board games, either alone or in any combination thereof.

It is another object of the present invention to provide a new mystic board game which may be easily and efficiently manufactured and marketed.

It is a further object of the present invention to provide a new mystic board game which is of a durable and reliable construction.

An even further object of the present invention is to provide a new mystic board game which is susceptible of a low cost of manufacture with regard to both materials and labor, and which accordingly is then susceptible of low prices of sale to the consuming public, thereby making such mystic board game economically available to the buying public.

Still yet another object of the present invention is to provide a new mystic board game which provides in the apparatuses and methods of the prior art some of the advantages thereof, while simultaneously overcoming some of the disadvantages normally associated therewith.

Still another object of the present invention is to provide a new mystic board game for providing entertainment by generating answers to various questions.

Even still another object of the present invention is to provide a new mystic board game that includes a game board with a top face having a plurality of spaced large designations each with number indicia and theme indicia situated therein. The top face of the game board further includes a plurality of small designations situated between each of the large designations. Each of the small designations has answer indicia positioned therein. Also included is a plurality of dice and a plurality of playing pieces. A plurality of theme cards are provided each having a plurality of numbered lines relating to various themes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an illustration of one of the theme cards of the present invention.

FIG. 8 is an illustration of One of the subject cards of the present invention.

FIG. 9 is a top view of one of the playing pieces of the present invention.

FIG. 10 is a side view of one of the playing pieces of the present invention.

FIG. 11 is a perspective view of a reference manual associated with the present invention.

DESCRIPTION OF THE PREFERRED EMBODIMENT

Figure 1:
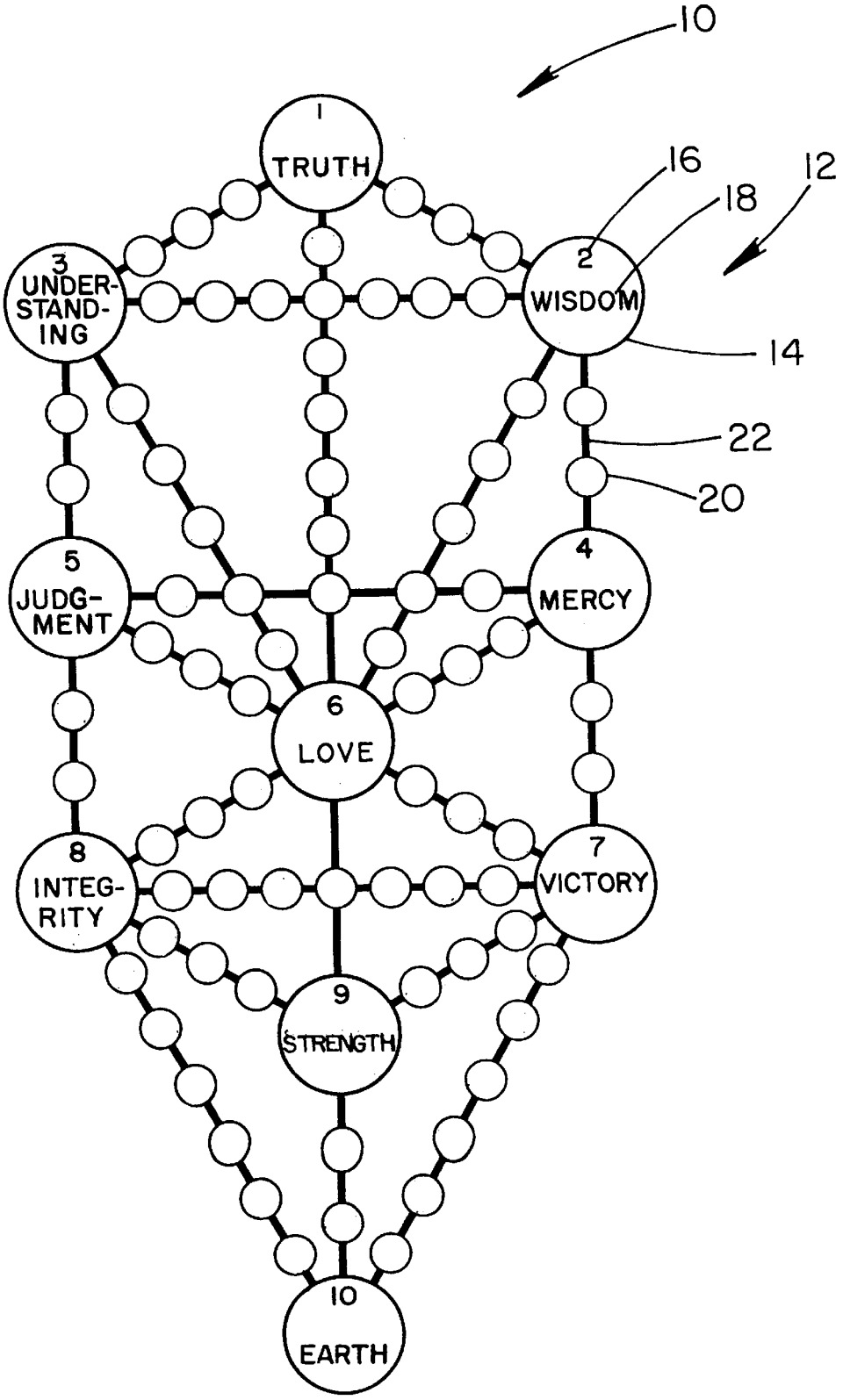
FIG. 1 is a top view of a new mystic board game according to the present invention.

With reference now to the drawings, and in particular to FIGS. 1 through 12 thereof, a new mystic board game embodying the principles and concepts of the present invention and generally designated by the reference numeral 10 will be described.

The present invention, designated as numeral 10, includes a game board 12 having a planar rectangular configuration with a top face. It should be noted that the game board may be constructed from fabric, leather, wood, metal, on paper as a poster, or made into a puzzle. The size of the game board may be enlarged (proportionally) on fabric to make a table cloth, or on wood to make a game table.

As shown in FIG. 1, the game board has a plurality of spaced large circles 14 each having number indicia 16 and theme indicia 18, or sanctuary indicia, situated therein. Each of the large circles is situated within one of three columns. It should be further noted that the large circles are staggered from top to bottom.

The top face of the game board further includes a plurality of small circles 20, or stepping stones, situated between each of the large circles. The small circles remain in linear alignment. Further, a bold linear line 22 collects the small circles and the large circles. It should be noted that each of the small circles has answer indicia 24 positioned therein. Note FIG. 12.

Figure 4:
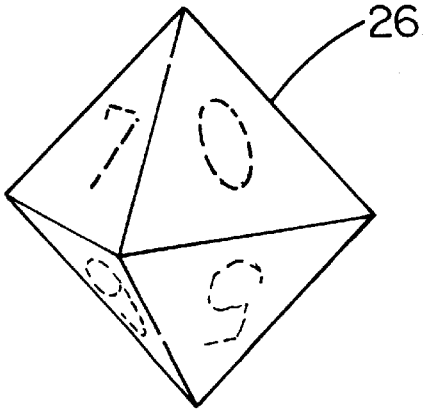
FIG. 4 is a perspective view of the red dice of the present invention.
Figure 5:
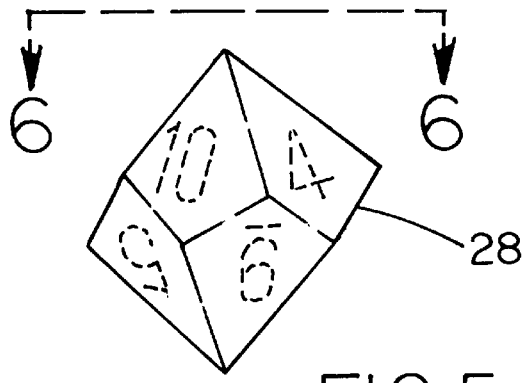
FIG. 5 is a perspective view of the white dice of the present invention.
Figure 6:
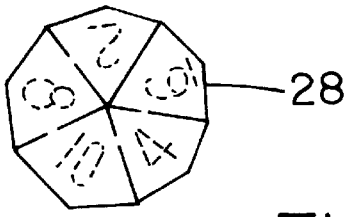
FIG. 6 is a top view of the dice of FIG. 5.
Figure 12:
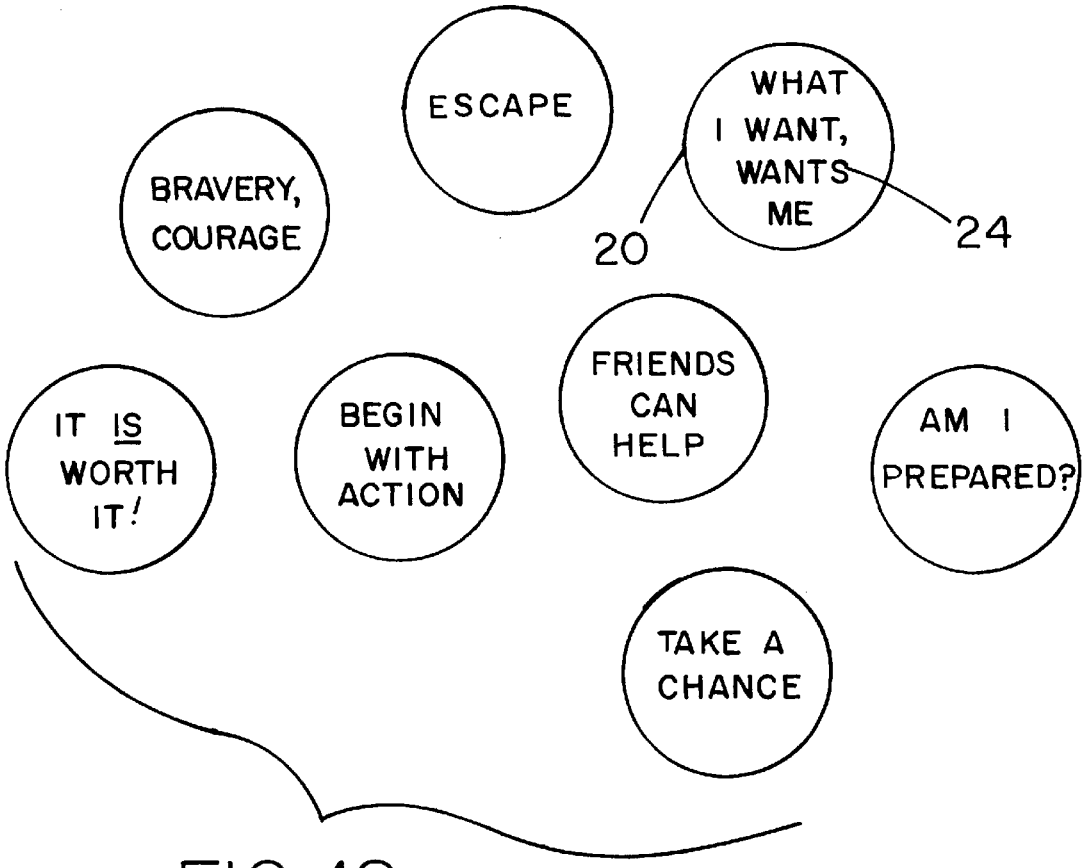
FIG. 12 is an illustration of the answer indicia of the small circles of the game board.

FIGS. 4–6 show a plurality of dice including a red dice 26 having eight sides with number indicia thereon ranging from 0–7. Associated therewith is a white dice 28 having ten sides with number indicia thereon ranging from 1–10.

Figure 2:
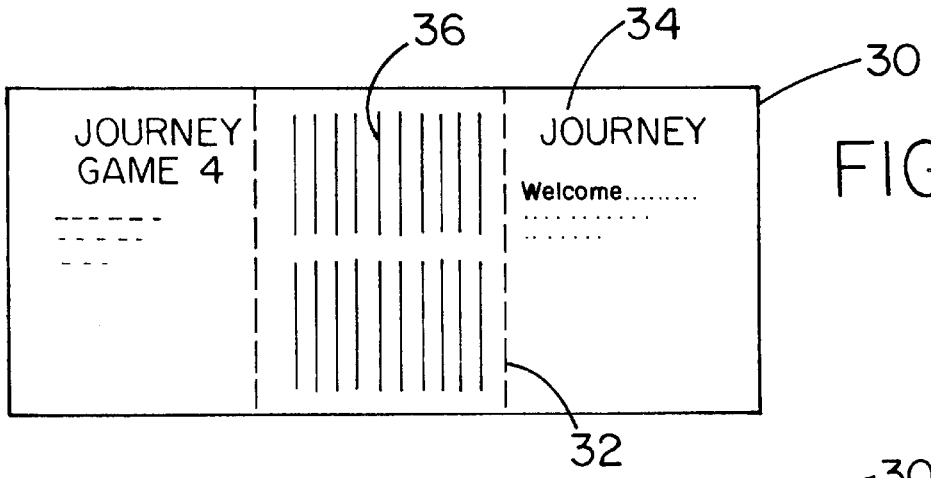
FIG. 2 is a top view of the instruction sheet of the present invention.
Figure 3:
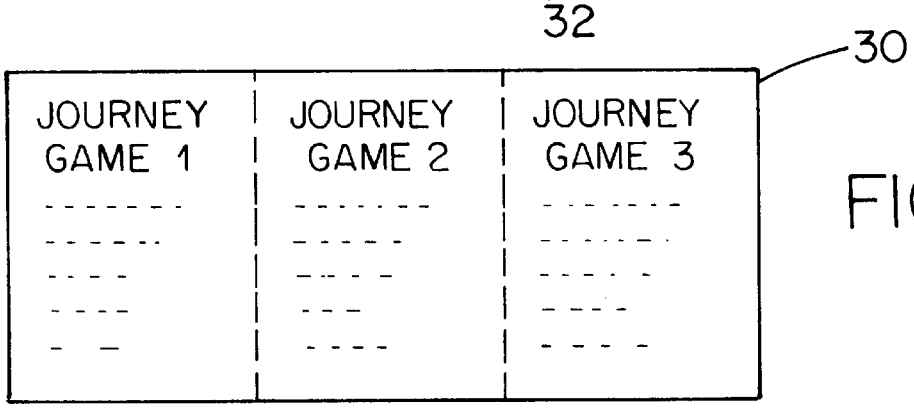
FIG. 3 is a bottom view of the instruction sheet of the present invention.

An instruction sheet 30 is provided having a rectangular periphery defined by a pair of elongated side edges and a pair of short end edges. As shown in FIGS. 2 & 3, the instruction sheet includes a plurality of folds 32 extending between the elongated side edges for defining a plurality of sections. Such sections include rule sections 34 on a front and back of the instruction sheet. Each rule section serves for displaying rules associated with one of a plurality of games. Also on the instruction sheet is a journal section 36 having two columns of a plurality of rows of blank lines. The rows of blank lines are divided up into groups each having theme indicia adjacent thereto. Such theme indicia corresponds with those the large circles of the game board.

FIGS. 9 & 10 show a plurality of playing pieces 38 constructed from glass and having an arcuate upper surface and a flat lower surface. FIG. 7 depicts one of a plurality of theme cards 40 each having a number associated therewith. Further situated on each theme card is a plurality of numbered lines each relating to one of various themes. Finally, a plurality of subject cards 42 are provided each having a plurality of numbered lines relating to various themes.

The method associated with the present invention will now be set forth. Play entails a predetermined number of players each being given a designated playing piece. Thereafter, the players take turns. Each of such turns starts with the player stating a question aloud. As an option, the question may be gleaned from one of the subject cards. Next, the white dice is rolled and one of the playing pieces is placed on one of the large circles which has number indicia corresponding to a number rolled on the white dice.

The red dice is then rolled ten times. After each roll, a predetermined procedure is carried out. This procedure first includes moving the appropriate playing piece between a number of adjacent circles corresponding with the number rolled by the red dice. If the playing piece lands on a large circle, a line is read from the associated one of the theme cards, as indicated by the number associated therewith. It should be noted that the line of the theme card that is read is that which has a number corresponding with the number rolled by the red dice. If, on the other hand, the playing piece lands on a small circle, the answer indicia of the small circle is read. In either case, the indicia or line may be recorded on the group of lines of the instruction sheet. The group of lines that is recorded on is preferably associated with the large circle that was last visited. This is for organization purposes so that the recordings may be reflected upon at a later time. It should be noted that rules corresponding to other games may also be set forth on the instruction sheet.

The original theme of the game is based on sacred geometry, the Kabbalah, and a garden/labyrinth type of adventure. Alternative themes (diagram and background) could reflect any of the following subjects: Space/Planets, Astrology, Love/Romance, Business/Finances, Metaphysical Symbols, Ocean/Treasure Chest, Sacred Saints, Education/Therapy, Numerology, Animals/Birds, Saints/Angels, Historic/Religious Figures, Archetypes.

While only one of the possible games has been set forth hereinabove, it should be noted that numerous additional games may be played. Following is an example of instructions to be included with the manual of the present invention. Such instructions not only include the game set forth hereinabove, but also three additional games.

A Brief Walk in the Garden

This Journey is a quick and powerful insight into your question. It gives you information regarding the recent events and current situation about your question, and how they are affecting your near future. Remember that the outcome can be altered. Journey only shows you what is probable given the past and present situations. "A Brief Walk in the Garden" can be played by one person, many people, or in teams.

1. State your question.
2. Roll both dice at the same time. Place three stones on the Sanctuary that corresponds with the number on the white dice. Read the phrase from the Sanctuary card that Corresponds with the number on the red dice. How does this relate to your question?
3. Now roll only the red dice. Move one stone that number of spaces. Use your intuition to determine which stepping stone you will land on. You can move your stone either forward or backward on any path, but not both in the same move. This represents your "recent past" regarding your question.
4. Roll the red dice again and move one of the other stones that number of spaces. This represents your "present position" relating to your question.
5. Roll the red dice one more time and move one of the other stones that number of spaces. This represents your "near future" in respect your question.
6. Discuss how all your answers relate to your question.

NOTE: If you roll ZERO on the red dice it means your current position is your answer.

Personal Example

| | |
|---|---|
| 1. Question: | What do I need to do to make this Journey game successful? |
| 2. I rolled a #7 Sanctuary: | Victory |
| 3. I rolled a #7 Recent past: | Get focused and organized. |
| 4. I rolled a #4 Present: | Uncovering the unknown. |
| 5. I rolled a #4 Near future: | Love - my perception of love indicates how much love I feel now. |

Discussion: I kept focused and used my strong organizational skills to create Journey. Many new personal insights came to me during it's creation. It is my hope that the amount of love and integrity I put into this game will be unveiled in your personal discoveries. Journey is successful!

A Stroll Through the Garden

This Journey is designed for a more thorough exploration of your question. Journey's "stroll through the garden" can be played by many people at the same time, or by one person.

1. State your question, then select the Subject card that corresponds best to your question.
2. To begin your "Stroll through the Garden" roll both dice at the same time.
3. Choose one stone and place it on the Sanctuary that corresponds with the number on the white dice. Then read the phrase from the Sanctuary card that corresponds with the number from the red dice.
4. Discuss how this relates to your question.
5. For the rest of your Journey roll both dice at the same time then . . .
   Read the phrase from the Subject card that corresponds to the number on the white dice. This is your question.
   Move your stone, intuitively on the stepping stones, to correspond with the number on the red dice. You can move your stone either forward or backward on any path, but not both in the same move. This is your answer.
   Discuss how these relate to your question and all previous answers too.
6. If you choose you can repeat step #5 over and over. There is no limit on how long you can stroll through the garden. When the answer become similar then it is probably time to end your stroll. Only you know when your "Stroll though the Garden" is finished.

NOTE: If you roll a ZERO on the red dice you do not move. Your current position is your answer. This indicates that it is an important message that you need to pay special attention to.

Power of Ten Journey (also set forth hereinabove)

The Power of Ten Journey is based on Tarot's Celtic Cross layout. This is the in most widely used Tarot spread and reveals many aspects on your answer.

1. State your question.
2. Roll the white dice and place a stone on the Sanctuary that corresponds with the number rolled. This Sanctuary is the "theme" of your question (it's deeper meaning), use it in conjunction with your answer.
3. Next roll the red dice. Move your stone (use your intuition) that number of spaces in the journey garden. You can move your stone either forward or backward oil any path, but not both in the same move. If you and on a Sanctuary read the phrase from the Sanctuary card that corresponds to the number on the red dice. You will repeat this for a total of ten rolls. Each roll represents the answer to your question (and theme) as it relates to the following ten categories. Roll once, read what that roll represents and the respective answer from the stepping stones in the garden, then continue each roll thereafter. NOTE: If you role a ZERO it means stay put. This is an important message that you need to pay attention to.

Roll #1 represents your "Present Position." It is the atmosphere in which your are presently working and living in as it relates to your question/theme. This represents you.

Roll #2 represents your "Immediate Influence." It is called the crossing card which shows what is influencing, such is the immediate involvement or obstacles involved about your present position (Roll #1).

Roll #3 represents your "Goal or Destiny." This is your higher consciousness, which indicates the best that can be accomplished by you, based upon the existing circumstances in regards to your question/theme.

Roll #4 represents your "Foundation." This is the basis of distant past events and influences which formed your existing feelings and thoughts today as they relate to your question/theme.

Roll #5 represents your "Recent Past Events." This shows you the most recent events or influences pertaining to your question/theme.

Roll #6 represents your "Future Influences. " This shows what you arc drawing into your life in the near future concerning your question/theme.

Roll #7 represents your "Questioner." Your present attitude. How you are dealing with, or reacting to, the current question/theme.

Roll #8 represents your "Environmental Factors." This shows you the current influences you have on others, or other people's (could also be environmental) influence on you, regarding your question/theme.

Roll #9 represents your "Inner Emotions." This is your subconscious, hidden emotions, hopes, fears or anxieties about your question/theme. It may also reveal secrets which you keep, or your ulterior motives.

Roll #10 represents your "Final Result." Integration/result of all the influences (answers) previously shown to you. This is indicates where you are headed based on current circumstances. If you choose to change your present thoughts or actions you can change the results.

Tree of Life Journey

The Tree of life Journey is designated for a profound soul searching into your question. This Journey usually works well when played by one or two people at a time due to the length of time it takes to complete. Tree of life Journey is designed for a deeper insight through the actual journalizing of your adventure.

1. State your question and write it down, along with your name and the date, on the Tree of Life Journal Sheet provided.
2. To begin your journey, roll the white dice. Place your stone on the Sanctuary that corresponds to the number. This is the theme of your question. Circle the name of this Sanctuary on your Journal Sheet. This will indicate your starting and stopping point on your journey.
3. Now roll the red dice. Move your stone (use your intuition) that number of spaces around the board. You can move your stone either forward or backward on any path, but not both in the same move.
4. Write on your Journal Sheet the phrase you have landed on. Use the right side of the sheet for your journalizing (unless you land on a Sanctuary). If you land on a Sanctuary use the phrase that corresponds with the number on the red dice you just rolled. In this case you write the information on the left side of the beside the Sanctuary name. This way you will know which Sanctuary you still need to land on.
5. Go around the board by repeating step number 3 and 4 until you have landed on all the Sanctuaries except tile one you began on. Do not land on this one until the end of the adventure. Each sanctuary must be landed on by an exact number on the dice of dice.
6. When all Sanctuaries have been visited you then return to the original Sanctuary (by an exact number on the dice) where your Tree of Journey began. This will be the end of your adventure.
7. Now is the time for an in-depth review of you entire Journey. Note any patterns that have come up, pay special attention to those messages that were repeated. Always relate your answer to your question/theme. If you are comfortable with it, discuss your Journey with another player and/or a friend. Sharing can help you develop even further insight into your Journey of life.

NOTE: If you land on the same space ignore than once, instead of writing it twice on your Journal Sheet, make a check next to this important message. If you roll a ZERO on the red dice it means stay where you are for this turn. This is an important message that is worth repeating.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A game comprising, in combination:

a game surface having a planar rectangular configuration with a top face including a plurality of spaced large circles each having number indicia and theme indicia situated therein, each of the large circles situated within three columns and staggered from top to bottom, the top face of the game surface further including a plurality of small circles situated between each of the large circles and in linear alignment wherein a bold linear line connects the small circles and the large circles, each of the small circles having answer indicia positioned therein;

a plurality of dice including a red dice having eight sides with number indicia thereon ranging from 0–7 and a white dice having ten sides with number indicia thereon ranging from 1–10;

an instruction sheet having a rectangular periphery defined by a pair of elongated side edges and a pair of short end edges, the instruction sheet including a plurality of folds extending between the elongated side edges for defining a plurality of sections, wherein the sections include rule sections each for displaying rules associated with one of a plurality of games and a journal section having two columns of a plurality of rows of blank lines, wherein the rows of blank lines are divided up into groups having theme indicia adjacent thereto which correspond with that of one of the large circles of the game surface;

a plurality of playing pieces constructed from glass and having an arcuate upper surface and a flat lower surface;

a plurality of theme cards each having a number associated therewith and plurality of numbered lines each relating to one of various themes;

a plurality of subject cards each having a plurality of numbered lines each relating to one of various themes; and a manual including various methods of playing the game.

2. A game comprising:

a game surface including a plurality of spaced large designations each having number indicia and theme indicia situated therein, the top face of the game surface further including a plurality of small designations situated between each of the large designations, each of the small designations having answer indicia positioned therein;

a plurality of dice;

a plurality of playing pieces; and a plurality of theme cards each having a plurality of numbered lines each relating to one of various themes.

3. A game as set forth in claim 2 wherein the playing pieces are constructed from glass.

4. A game as set forth in claim 2 and further including an instruction sheet having a rectangular periphery defined by a pair of elongated side edges and a pair of short end edges, the instruction sheet including a plurality of folds extending between the elongated side edges for defining a plurality of sections, wherein the sections include rule sections each for displaying rules associated with one of a plurality of games and a journal section having two columns of a plurality of rows of blank lines.

5. A game as set forth in claim 2 wherein a first dice is included with a first number of sides and a second dice is included with a second number of sides.

6. A method of playing a game comprising the steps of:

providing a game surface having a planar rectangular configuration including a plurality of spaced large circles each having number indicia and theme indicia situated therein, each of the large circles situated within three columns and staggered from top to bottom, the top face of the game surface further including a plurality of small circles situated between each of the large circles and in linear alignment wherein a bold linear line connects the small circles and the large circles, each of the small circles having answer indicia positioned therein;

providing a plurality of dice including a red dice having eight sides with number indicia there on ranging from 0–7 and a white dice having ten sides with number indicia thereon ranging from 1–10;

providing an instruction sheet having a rectangular periphery defined by a pair of elongated side edges and a pair of short end edges, the instruction sheet including a plurality of folds extending between the elongated side edges for defining a plurality of sections, wherein the sections include rule sections each for displaying rules associated with one of a plurality of games and a journal section having two columns of a plurality of rows of blank lines, wherein the rows of blank lines are divided up into groups having theme indicia adjacent thereto which correspond with that of one of the large circles of the game surface;

providing a plurality of playing pieces constructed front glass and having an arcuate upper surface and a flat lower surface;

providing a plurality of theme cards each having a number associated therewith and plurality of numbered lines each relating to one of various themes;

providing a plurality of subject cards each having a plurality of numbered lines each relating to one of various themes;

stating a question aloud;

rolling the white dice;

placing one of the playing pieces on one of the large circles which has number indicia corresponding to a number rolled on the white dice; and rolling the red dice, wherein a procedure carried out after each roll includes the step of moving one of the playing pieces between a number of adjacent circles corresponding with a number rolled by the red dice.

7. A method of playing a game as set forth in claim 6 wherein the procedure further includes the steps of:

reading a line of one of the theme cards which has a number corresponding with that rolled by the red dice only if the playing piece lands on a large circle, reading the answer indicia of one of the small circles only if the playing piece lands thereon, and recording the indicia read after each roll of the red dice on the group of lines of the instruction sheet.

* * * * *